US006712397B1

(12) United States Patent
Mayer et al.

(10) Patent No.: US 6,712,397 B1
(45) Date of Patent: Mar. 30, 2004

(54) EMBOSSED DATA CARRIER

(75) Inventors: Karlheinz Mayer, Augsburg (DE); Roger Adamczyk, Munich (DE); Eduard Wisjak, Vaterstetten (DE); Christof Baldus, Munich (DE)

(73) Assignee: Giesecke & Devrient GmbH (DE)

( * ) Notice: Subject to any disclaimer, the term of this patent is extended or adjusted under 35 U.S.C. 154(b) by 0 days.

(21) Appl. No.: 09/787,921

(22) PCT Filed: Sep. 29, 1999

(86) PCT No.: PCT/EP99/07215

§ 371 (c)(1),
(2), (4) Date: Jun. 12, 2001

(87) PCT Pub. No.: WO00/20225

PCT Pub. Date: Apr. 13, 2000

(30) Foreign Application Priority Data

Oct. 2, 1998 (DE) ..... 198 45 552

(51) Int. Cl.[7] ..... B42D 15/00

(52) U.S. Cl. ..... 283/91; 285/72; 428/916; 428/161

(58) Field of Search ..... 283/67, 70, 72, 283/74, 77, 82, 83, 85, 86, 91, 92, 94, 95, 96, 107, 109, 111, 901, 902, 904; 428/179, 914, 915, 916, 161, 162

(56) References Cited

U.S. PATENT DOCUMENTS

| | | | | |
|---|---|---|---|---|
| 4,250,217 A | | 2/1981 | Greenaway | |
| 4,597,592 A | | 7/1986 | Maurer et al. | |
| 4,672,891 A | | 6/1987 | Maurer et al. | |
| 4,988,126 A | | 1/1991 | Heckenkamp et al. | |
| 5,433,807 A | | 7/1995 | Heckenkamp et al. | |
| 6,036,233 A | * | 3/2000 | Braun et al. | 283/91 |

FOREIGN PATENT DOCUMENTS

| | | |
|---|---|---|
| DE | 25 55 215 | 5/1977 |
| DE | 27 01 176 | 12/1977 |
| DE | 30 09 097 | 9/1981 |
| DE | 82 36 980 | 7/1985 |
| DE | 37 41 179 | 6/1989 |
| DE | 43 28 413 | 3/1995 |
| DE | 44 21 407 | 6/1995 |
| DE | 44 41 198 | 5/1996 |
| EP | 0 640 493 | 3/1995 |
| EP | 0 790 898 | 8/1997 |

* cited by examiner

*Primary Examiner*—Willmon Fridie, Jr.
(74) *Attorney, Agent, or Firm*—Bacon & Thomas, PLLC

(57) ABSTRACT

A data carrier (1), such as a security, bank notes, ID card or the like, that is embossed in such a way that at least part of said embossment (2) is shaped like an oblique plane (3).

20 Claims, 2 Drawing Sheets

EMBOSSED DATA CARRIER

BACKGROUND OF THE INVENTION

The invention concerns a data carrier such as a security, banknote, identity card or similar which features embossing in a predefined area.

It has long been usual to give securities, such as shares for example, an embossing. Such an embossing introduced into the paper is usually described as blind embossing. Common principles have even been drawn up by the German securities exchanges for the printing of securities ("stock exchange guidelines") which stipulate certain basic requirements for the form and execution of such embossings. For example, according to these stock exchange guidelines the embossing must be positioned in a particular area of the security. Since these embossings also serve as an anti-forgery feature, according to the stock exchange guidelines they must not simply take the form of a letter, but must involve a pattern as complex as possible, preferably using guilloches in order to make forgery more difficult.

The advantage of such blind embossing lies in the simplicity of checking, which can be carried out by purely tactile means without additional aids. In addition, special three-dimensional optical impressions are produced on viewing the embossing due to light/shade effects. However, the perceptibility of the embossing is greatly limited by diffuse or poor lighting.

BRIEF SUMMARY OF THE INVENTION

The invention is therefore based on the problem of suggesting a data carrier with an embossing which displays an increased visual perceptibility.

According to the invention, at least part of the embossing must display the form of an inclined plane, i.e. the height or depth of the embossing decreases slowly, in relation to the rest of the surface of the data carrier, starting from a maximum value, in a predefined direction. The decrease in the height or depth of the embossing thereby preferably follows a simple mathematical function, for example a straight line, a parabola or a hyperbola, whereby the continual decrease in the form of a straight line—the classic decline of an inclined plane—is preferred. For this reason, the term "inclined plane" is used in the following for the decrease in the height or depth of the embossing in accordance with the invention, but this is not intended to be restricted simply to the classic straight-line decrease, but covers all other possible forms of the declining course. The embossing can take place in such a way that the embossed structures are raised in relation to the unembossed surface of the data carrier or can form indentations. A combination of both within an embossing is also possible. The lateral dimensions and the height or depth of the embossing are so dimensioned that no optical diffraction effect occurs.

According to a preferred embodiment, the embossing consists of several partial areas in the form of inclined planes. In this way, a piece of information which is to be embossed can be created from several inclined planes. Due to the variation in the height of the embossing within a partial area and the differences in the embossing height between different partial areas, in addition to the usual light and shade effects, contrasts easily perceptible to the human eye are created which make the embossing as a whole more distinctive and thus easier to perceive. Since any desired alphanumeric characters, patterns or other graphic representations can be created with the aid of partial areas in the form of inclined planes, it is possible to create very complex and complicated embossing patterns which additionally increase security against forgery. The dimensions of the individual inclined planes must simply be chosen in such a way that each plane is easily recognisable at a normal viewing distance without any aids. All the inclined planes used can thereby display the same type of height profile, i.e. the gradient of embossing heights/depths is the same in all partial areas, for example straight-line or parabolic in form. However, any mixtures of planes of differing inclination can also be used, whereby not only the form of the height profile can be varied, but also individual parameters within a profile. For example, inclined planes can be used whereby, though all the inclined planes display an embossing height profile in the form of a straight line, the angle of inclination of these straight lines varies. However, each embossing features at least one partial area or inclined plane the angle of inclination of which is less than 10° in relation to the surface of the data carrier and which has a lateral dimension in the direction of the greatest inclination of more than 1.5 mm. In the case of a curved embossing height profile which does not display the form of a straight line, the angle of inclination is defined between the surface of the data carrier and the straight line produced by the connecting line between the starting point and the point with the maximum embossing height or depth.

Nor does the maximum embossing height or depth, which can be up to 250 $\mu$m, necessarily need to be identical for all inclined planes. In order to increase security against forgery further, the inclined planes can be overlaid with additional embossing structures.

For reasons of clarity, only embodiments with raised embossing which features inclined planes with a straight-line height profile are chosen for the following explanations.

The invented embossing can be produced using any type of embossing tool. However, it is preferably created using the intaglio imprinting method. For this purpose, the embossing structures are engraved in a metal plate using a known method. A computer-controlled process for manufacturing such intaglio printing plates is described in WO 97/48555, for example. During the printing process, the paper is pressed into the depressions in the engraved metal plate and in this way permanently deformed. To create a blind embossing, these printing plates are not filled with ink during the printing process but are simply used to deform, i.e. emboss, the document material, for example paper.

According to a preferred embodiment, the embossing consists of several partial areas in the form of inclined planes which directly adjoin one another and the inclination of which runs contrary to one another. The planes can thereby be arranged next to one another in such a way that one inclined plane declines in one predetermined direction while the inclined plane arranged next to it rises, in a wedge form, in this direction.

According to a further embodiment, the inclined planes can also adjoin one another in such a way that they quasi overlap or would interpenetrate one another if extended. Two adjoining inclined planes thereby form a V-formed height profile, for example. Several, e.g. three or four, directly adjoining inclined planes can be arranged and aligned with one another in such a way that they form a pyramid.

Advantageously, a data carrier can also feature several embossings spaced at intervals from one another. According to a preferred embodiment, at least one inclined plane continues over several embossings, especially adjoining ones.

According to a further preferred embodiment, at least one part of the embossing displays the form of an inclined plane and, in addition, the embossed area of the data carrier features at least one coating or a sequence of coatings the optical effect of which varies depending on the viewing angle. Optically variable materials such as interference coatings, liquid crystal coatings or coatings which display diffractive structures display a change in colour when the viewing angle is altered, which cannot be reproduced with copying machines. They are therefore frequently used as anti-copying elements. If such coatings are provided in the area of the invented embossing, then a clearly perceptible alteration of the viewing angle occurs due to the height profile of the inclined planes, i.e. colour differences occur along the height profile of the embossing which make the embossing stand out against the unembossed surroundings and thus make it more easily perceptible.

A similar effect occurs if highly-reflective coatings, e.g. metallic coatings, are featured in the area of the invented embossing, because at the angle of incidence the highly-reflective coatings appear very bright and shiny, whereas at all other angles they appear darker and less brilliant. Because of the height profile of the inclined planes, certain areas of the embossing appear bright and shiny under a particular viewing angle, whereas other areas appear darker. In this way, an additional contrast is created which makes the embossing stand out better.

The aforementioned optically-variable coatings can be applied to the data carrier using any known method. For example, they can be prepared on a different substrate and then transferred to the data carrier using a transfer process. The prepared substrate material is thereby brought into contact with the data carrier via an adhesive coating and bonded with the data carrier, possibly under the application of heat and pressure. The substrate is then pulled off, whereas the transferred coating remains on the data carrier.

Depending on the material which is to be transferred, the substrate material must be treated with different sequences of coatings during preparation. For example, in the case of diffractive structures, the substrate material is usually given a plastic coating in which the diffractive structures are embossed in the form of a relief. A thin coating of aluminium is then vapour-deposited onto this relief and finally covered with a coating of adhesive. However, under certain circumstances, further coatings can be applied to the substrate material and transferred to the data carrier. A variety of methods for the manufacture of substrate materials with optically-variable coatings is known from the prior art, for example from DE 29 07 186 C2, US-A-3,858,977, EP 0 420 262 A1, EP 0 435 029 B1.

However, the coatings can also be applied in the form of coatings of coloured ink. In this case, the coatings creating the optically-variable effect contain pigments which are mixed with usual printing ink binding agents and squeegeed or printed onto the data carrier. Interference coating pigments are, for example, sold by the company Merck under the name IRIODINE® or by BASF under the name PALIOSECURE®.

Further embodiments and advantages of the invention are explained with reference to the figures. It should be pointed out that the figures do not show a true-to-scale representation, but are simply intended to illustrate the invention.

DETAILED DESCRIPTION OF THE INVENTION

Figure 1:
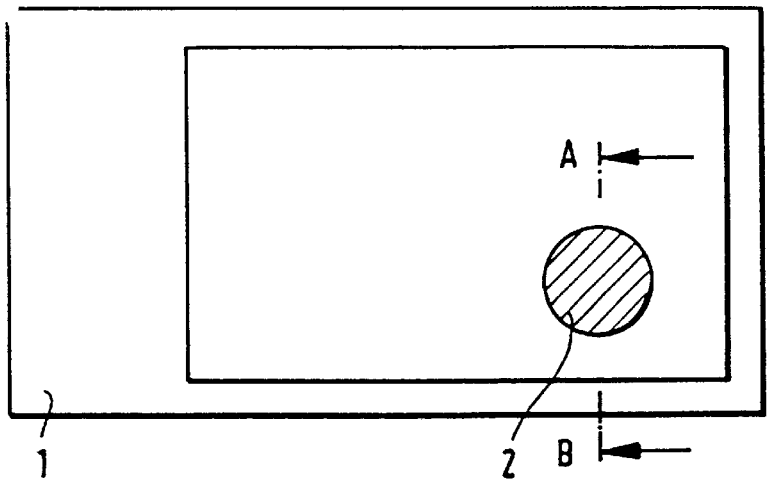
FIG. 1 shows a sketch of a data carrier in accordance with the invention.

FIG. 1 shows a data carrier 1 in accordance with the invention, in this case a banknote. Normally it consists of paper which is manufactured of cotton fibres and/or synthetic fibres. According to the invention, this banknote features an embossed area 2. This embossed area 2 can, in addition, feature one or more optically-variable coatings which can be applied to the banknote before or after the embossing process.

Figure 2:
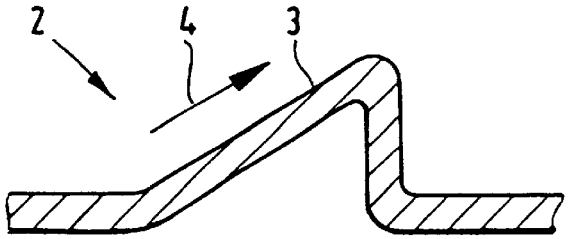
FIG. 2 shows a cross-section through the data carrier in accordance with the invention along A–B in FIG. 1

FIG. 2 shows a section through the embossing 2 along A–B. According to this, the embossing 2 consists of an inclined plane 3. The embossing height profile along the arrow 4 follows a straight line. However, it can also display another form. Preferably, however, the embossing height profile can be described by a simple mathematical function.

Figure 3:
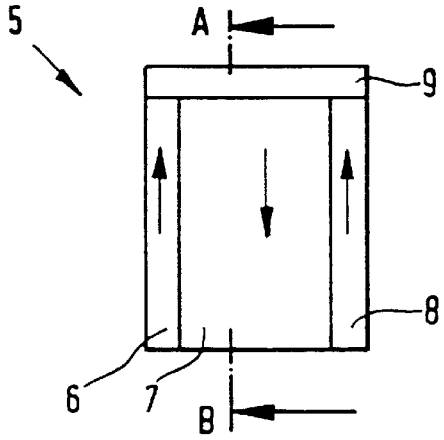
FIG. 3 shows a sketch of an embossing in accordance with the invention, in plan view.

FIG. 3 shows an embossing 5 in plan view which has the form of a bar. This embossing 5 consists of four directly adjoining partial areas 6, 7, 8, 9, whereby the partial areas 6, 7, 8 have the form of an inclined plane and are arranged next to one another. Analogously to FIG. 2, the arrows indicate the direction in which the height of the embossing rises. This shows that the inclined planes of the partial areas 6, 7 respectively 7 and 8 are arranged contrary to one another. In contrast, the partial area 9 is not embossed in the form of an inclined plane, but displays a constant embossing height.

The partial areas 6, 8, 9 could also be described as the outline and partial area 7 as the filled area of a character, for example the letter "I". This way of breaking down an alphanumeric or graphic representation into an outline and a filled area has proved especially advantageous. Both the outline and the filled area thereby feature at least one partial area in the form of an inclined plane, whereby the inclined planes of the outline and the filled area are arranged contrary to one another.

Figure 4:
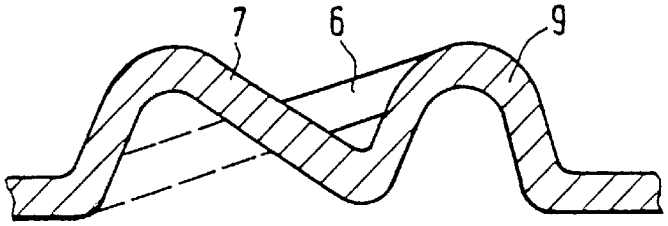
FIG. 4 shows a cross-section along A–B in FIG. 3.

FIG. 4 shows, diagrammatically, a section along A–B in FIG. 3 in order to illustrate the arrangement and alignment of the inclined planes and the course of the embossing height profile. The inclined plane of the partial area 7 thereby declines from a maximum embossing height value to the level of the unembossed data carrier. The partial area 9, embossed with a constant embossing height, adjoins this area. In addition, the inclined plane of the partial area 6 can be seen in the background, which in the left-hand area is covered by the inclined plane of the partial area 7 and is therefore represented by a broken line in this area.

Figure 5:
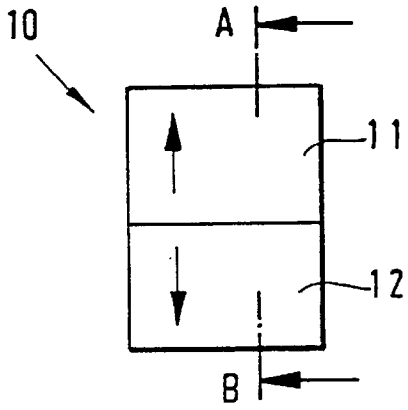
FIG. 5 shows a sketch of an embossing in accordance with the invention, in plan view.

FIG. 5 shows a further embodiment of an embossing in accordance with the invention. In this case, the embossing 10 also consists of two partial areas 11, 12, which, however, in contrast to the partial areas shown in FIG. 3, are not arranged next to one another but quasi overlapping one another. However, in this case too, the inclined planes of the partial areas 11, 12 are aligned contrary to one another, as indicated by the arrows.

Figure 6:
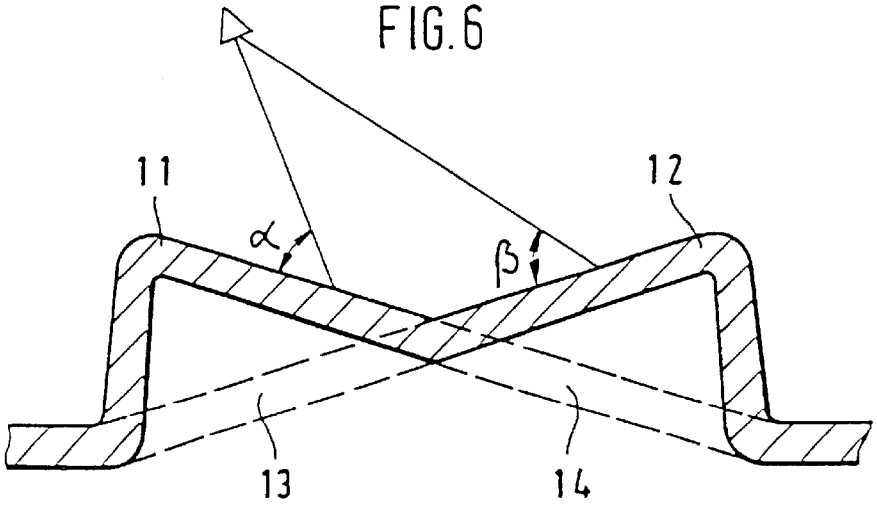
FIG. 6 shows a cross-section along A–B in FIG. 5.

The course of the embossing height profile of this embossing 10 is shown by the cross-section along A–B, which is illustrated in FIG. 6. It can be seen here that the inclined planes of the partial areas 11, 12 intersect and the embossing 10 possesses a quasi V-formed embossing height profile. The areas 13, 14 shown by broken lines were simply drawn in to indicate the theoretical course of the individual inclined planes in the partial areas 11 and 12 without the overlapping.

Since the viewing angle along the section changes relatively greatly, the viewer perceives the embossing, from a fixed observation point, under clearly differing angles of incidence, as indicated in FIG. 6. Due to this fact, additional contrast is produced, which makes the embossing stand out and thus makes it easier for the eye to perceive.

This effect can be further intensified by giving the area of the embossing an optically-variable coating. Preferably, an optically-variable printing ink is used for this coating which essentially consists of a binding agent and optically-variable pigments. Suitable optically-variable pigments are, for example, interference coating pigments or liquid crystal pigments which show a change of colour on alteration of the viewing angle. If these inks are applied to the inclined planes, then the viewer perceives the colour of each partial area 11, 12 at a different angle of incidence, i.e. due to the embossing height profile the partial areas of the embossing present themselves to the viewer at a clearly different viewing angle, so that colour differences within the embossing occur which improve the visual perceptibility of the embossing.

Naturally, several different printing inks or one printing ink with several different optically-variable pigments can also be used. The printing inks can be applied using any method. However, a screen-printing process is used in preference.

The data carrier material can consist of any embossable material, but paper, in any composition, is preferably used. However, plastic foils or multi-layered laminates of different materials, which are used for example for identity cards and passports, can be embossed in accordance with the invention.

What is claimed is:

1. In a data carrier, for example a security, banknote, identity card or the like, which is provided permanently in a predefined area of its surface with an embossing visible to the human eye without auxiliary aids, the improvement comprising: at least part of the embossing has the form of at least one inclined plane extending at a constant slope relative to a generally planar surface of unembossed areas of the data carrier to a predetermined maximum height or depth.

2. In a data carrier, for example a security, banknote, identity card or the like, which is provided permanently in a predefined area of its surface with an embossing visible to the human eye without auxiliary aids, the improvement comprising: at least part of the embossing has the form of an inclined plane having an angle of inclination of less than 10° relative to a generally planar surface of unembossed areas of the data carrier and a lateral dimension in the direction of a maximum rise in the inclined plane of more than 1.5 mm.

3. The improvement in a data carrier in accordance with claim 1 or 2, wherein the embossing displays several inclined planes.

4. The improvement in a data carrier in accordance with claim 3, wherein the inclined planes directly adjoin one another and are aligned contrary to one another.

5. The improvement in a data carrier in accordance with claim 4, wherein the inclined planes are arranged next to one another.

6. The improvement in a data carrier in accordance with claim 1 or 2, wherein the embossing comprises at least one outline and a filled area enclosed by this outline, wherein both the outline and the filled area comprise at least one inclined plane, and that at least one inclined plane of the outline and one inclined plane of the filled area are aligned contrary to one another.

7. The improvement in a data carrier in accordance with claim 4, wherein the inclined planes overlap one another.

8. The improvement in a data carrier in accordance with claim 1 or 2, wherein the embossing is a blind embossing.

9. The improvement in a data carrier in accordance with claim 1 or 2, wherein the embossing is produced using an intaglio printing process.

10. The improvement in a data carrier in accordance with claim 1 or 2, wherein the inclined planes display a maximum embossing height of 250 $\mu$m.

11. The improvement in a data carrier in accordance with claim 1 or 2, wherein the inclined planes are overlaid by additional embossed structures.

12. The improvement in a data carrier in accordance with claim 1 or 2, the embossing is in a form selected from the group consisting of alphanumeric characters, patterns and graphic representations.

13. The improvement in a data carrier in accordance with claim 1 or 2, wherein the embossed area of the data carrier is provided with at least one coating or series of coatings the visual optical impression of which varies depending on the viewing angle.

14. The improvement in a data carrier in accordance with claim 13, wherein the coating or series of coatings is applied using a screen-printing or transfer process.

15. The improvement in a data carrier in accordance with claim 13, wherein the coating or series of coatings is in a form selected from the group consisting of interference coatings, liquid crystal coatings and highly reflective coatings.

16. The improvement in a data carrier in accordance with claim 15, wherein the highly-reflective coating is a metallic coating.

17. The improvement in a data carrier in accordance with claim 13, wherein the coating or series of coatings comprises of a printing ink and contains optically variable pigments selected from the group consisting of interference coating pigments, liquid crystal pigments and metallic pigments.

18. The improvement in a data carrier in accordance with claim 13, wherein the coating or series of coatings comprise diffractive structures selected from the group consisting of holograms, cinegrams, and diffraction screens.

19. The improvement in a data carrier in accordance with claim 1 or 2, wherein the data carrier includes several embossings positioned at intervals from one another.

20. The improvement in a data carrier in accordance with claim 19, wherein one inclined plane continues over several embossings.

* * * * *